United States Patent [19]
Takamura et al.
[11] 4,186,586
[45] Feb. 5, 1980

[54] BILLET AND PROCESS FOR PRODUCING A TUBULAR BODY BY FORCED PLASTIC DEFORMATION

[75] Inventors: Masayuki Takamura; Norio Shinoda; Kazuo Kurahashi; Masataka Hatae, all of Hamamatsu, Japan

[73] Assignee: Nippon Gakki Seizo Kabushiki Kaisha, Japan

[21] Appl. No.: 938,424

[22] Filed: Aug. 31, 1978

Related U.S. Application Data

[63] Continuation-in-part of Ser. No. 801,052, May 27, 1977, abandoned, which is a continuation of Ser. No. 645,367, Dec. 30, 1975, abandoned.

[30] Foreign Application Priority Data

Jul. 18, 1975 [JP] Japan ..... 50/87221

[51] Int. Cl.[2] ..... B21C 23/08

[52] U.S. Cl. ..... 72/264; 72/370; 29/423; 428/585; 428/586

[58] Field of Search ..... 72/264, 370; 29/423; 428/585, 586

[56] References Cited

U.S. PATENT DOCUMENTS

| | | | |
|---|---|---|---|
| 1,390,746 | 9/1921 | Armstrong | 29/423 |
| 1,574,551 | 2/1926 | Bumford | 29/423 |
| 2,986,810 | 6/1961 | Brick | 29/423 |
| 3,138,856 | 6/1964 | Kuchek | 29/423 |
| 3,201,858 | 8/1965 | Valyi | 29/423 |

FOREIGN PATENT DOCUMENTS

| | | | |
|---|---|---|---|
| 178292 | 4/1922 | United Kingdom | 72/370 |

*Primary Examiner*—Lowell A. Larson
*Attorney, Agent, or Firm*—Ostrolenk, Faber, Gerb & Soffen

[57] ABSTRACT

An improved billet and process for producing a tubular body by forced plastic deformation is disclosed. The billet includes a metallic tubular sheath, a metallic center core and a salt intermediate core. The radial thickness of the metallic tubular sheath is equal to or less than 0.11 times the outer diameter of the metallic tubular sheath. The metallic center core is positioned within the tubular sheath and is surrounded by the salt intermediate core which fills the cylindrical space between the tubular sheath and the center core. In the process of the present invention, the foregoing billet is subjected to forced compulsory deformation to reduce the diameter of the billet. Thereafter, the intermediate core is removed through solution and the center core is drawn out of the sheath in order to obtain the tubular body.

13 Claims, 6 Drawing Figures

BILLET AND PROCESS FOR PRODUCING A TUBULAR BODY BY FORCED PLASTIC DEFORMATION

RELATED APPLICATIONS

This application is a Continuation-In-Part of U.S. Application Ser. No. 801,052, filed May 27, 1977, which is in turn a Continuation of U.S. Application Ser. No. 645,367, filed Dec. 30, 1975, both now abandoned.

BACKGROUND OF THE INVENTION

The present invention relates to an improved billet and process for producing a tubular body by forced plastic deformation and more particularly relates to improvements in the process for producing a wide variety of tubular bodies such as heat pipes by a novel combination of the use of a billet of a core and sheath construction with use of conventional forced plastic deformation such as hydrostatic extrusion, swagging and drawing under process conditions similar to those employed for processing solid rod bodies.

In one known process for producing a tubular body by forced plastic deformation, applied to a billet of the core and sheath construction, a billet comprising at least one axially elongated salt core and an insoluble sheath pipe wholly embracing the core is prepared, the billet so prepared is then subjected to a forced plastic deformation such as hydrostatic extrusion to reduce the diameter of the billet, and, finally the salt core is removed through solution (e.g., by blowing steam through the core) in order to obtain the tubular body.

In cases where the foregoing process is employed in the production of tubular bodies in which the extent of the diametric reduction (i.e., the compaction ratio) is very large, or in cases where tubular bodies having numerous axially elongated radial fins are to be reproduced, several technical problems are encountered. Particularly, as a result of the crystallinity of the salt used as the core material, it is difficult to obtain high precision results. That is, it is quite difficult to achieve a high degree of similarity between the shape of the original material sheath pipe and the final tubular body. Further, when the foregoing known billet is used, the material used for the core (salt) is removed through solution at the final stage of the process. This removal of the core inevitably causes two technical problems: large consumption of the core material and pollution of the environment as a result of the disposal of the salt core.

A second known process for producing a tubular body by forced plastic deformation applied to a billet of the core and sheath construction is disclosed in U.S. Pat. No. 1,390,746 issued to Armstrong. The Armstrong patent discloses a billet having a relatively thick outer sheath which encapsulates a complex core including a metallic central core and a refractory intermediate core disposed between the outer sheath and the inner core. In accordance with the process disclosed in Armstrong, a billet of the foregoing construction is subjected to classic deformation to produce the diameter thereof. Thereafter, the inner metallic core is mechanically removed and the intermediate refractory core is removed by reaming. The billet and process of the Armstrong patent have two primary drawbacks. Initially, since the intermediate refractory core is not easily soluble, it must be removed by reaming. Additionally, due to the mechanical properties of the refractory material, it has been found that satisfactory results cannot be obtained when the ratio of the sheath thickness T to the outer diameter of the pipe is equal to or less than 0.11. Tests establishing these results are reviewed in some detail below.

OBJECTS AND BRIEF DESCRIPTION OF THE INVENTION

It is a principal object of the present invention to provide and improved process for producing a tubular body by forced plastic deformation with enhanced precision resulting from the process despite the fact that a large compaction ratio is encountered in the deformation.

It is another object of the present invention to provide an improved process for producing a tubular body having numerous axially elongated radial fins by forced plastic deformation wherein enhanced precision in the end product is obtained through the use of the novel process.

Another object of the present invention is to provide an improve process for producing a tubular body by forced plastic deformation applied to a billet having a complex core including a non-soluble inner core and a salt intermediate core whereby consumption of the salt is significantly reduced.

It is a further object of the present invention to provide an improved process for producing a tubular body applied to a billet including the employment of a complex core which produces less pollution than the known all salt core.

It is yet another object of the present invention to provide an improved process for producing a tubular body applied to a billet whose sheath thickness t is equal to or less than 0.11 times the outer diameter d of the billet.

In order to attain the above described objects, the billet of the present invention comprises:

- an outer sheath whose thickness t is equal to or less than 0.11 times the outer diameter d thereof;
- a non-soluble inner core;
- a salt intermediate core disposed between said sheath and non-soluble inner core.

Water soluble salts are preferably used for the soluble core, for example, a simple salt such as sodium sulfate, sodium carbonate and sodium chloride is advantageously used. However, in general, compound salts are more suitable for use in the present invention than simple salts because of their relatively small rate of contraction. Exemplary of such salts are sodium carbonate with potassium chloride and sodium chloride; sodium carbonate with sodium chloride; sodium carbonate with potassium chloride; and calcium carbonate with potassium chloride.

The sheath pipe is preferably made of a metallic material such as aluminum, copper, brass, mild steel and their alloys. The above, as well as other objects of the invention, will become apparent from consideration of the following description and drawings in which.

DETAILED DESCRIPTION OF THE INVENTION

In the following description, reference will be made mainly to embodiments in which hydrostatic extrusion is used for the diametric reduction by forced plastic deformation as a typical example. However, it should be noted that other types of forced plastic deformations such as swagging, drawing and extruding can be used in the process of the present invention. Such forced plastic deformations can be carried out either at room temperature or at an escalated temperature which does not cause melting of either the metal or the salt intermediate core during the process. The process temperature may also advantageously be adjusted in accordance with the extent of the diametric reduction by the forced plastic deformation.

Figure 1A:
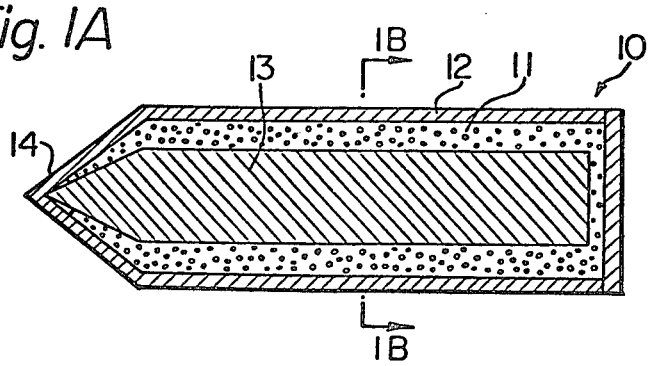
FIG. 1A is a cross-sectional side plan view of an embodiment of the billet used in the process of the present invention.
Figure 1B:
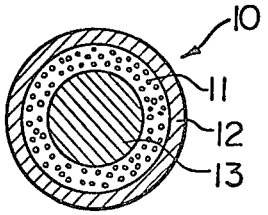
FIG. 1B is a section looking in the direction of arrows 1B—1B of FIG. 1A.

An embodiment of the billet in accordance with the present invention is shown in FIGS. 1A and 1B, in which a billet 10 includes an intermediate salt core 11, a sheath pipe 12 wholly embracing the intermediate core 11 and a center core 13 embedded within the intermediate core 11. In other words, the intermediate core 11 in this embodiment is used in the form of a filler between the center core 13 and the sheath pipe 12.

As already described, the intermediate core 11 is made of an easily soluble compound salt. One typical example of such a water soluble compound salt contains sodium chloride as the base, 30 to 50 percent by weight of potassium chloride and less than 10 percent by weight of sodium chloride. The sheath pipe 12 is preferably made of metallic materials such as aluminum, copper, brass, mild steel and their alloys, which materials are suited for extrusion operations.

The center core 13 is preferably a material such as metal which is insoluble to the solvent for the intermediate core 11 and the occupation ratio thereof in the transverse cross-sectional surface area of the inner space of the sheath pipe 12 should be 10 percent or larger (i.e., the cross-sectional area A or the core 11 should be $A_{11} \geqq 0.10$ where $A_{12}$ is the area of the region encircled by sheath 12). When the occupation ratio falls short of this value, no appreciable effect can be expected. The thickness of the soluble core 11 between the center core 13 and the sheath pipe 12 should be 1.0 mm. or larger.

In the practical mill production system, preparation of the billet 10 is carried out either by filling the molten material for the intermediate core 11 into a cylindrical space confined by the inner wall of the sheath pipe 12 around the center core 13 placed in position within the sheath pipe, or by compaction casting.

The billet 10 is provided with a tapered nose 14 which is so shaped as to fit the compulsory plastic deformation to be applied thereto. The billet 10 so prepared is then subjected to a compulsory plastic deformation such as hydrostatic extrusion, drawing and swagging for minimization of its diameter.

Figure 2:
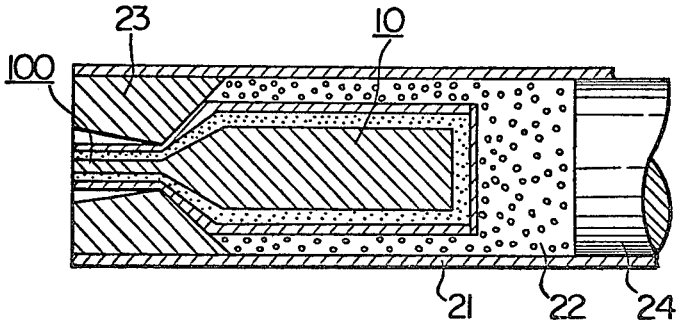
FIG. 2 is a partial cross-sectional side plan view of the hydrostatic extrusion system in accordance with the present invention.

In the embodiment shown in FIG. 2, the billet 10 is subjected to hydrostatic extrusion, in which the hydrostatic extrusion device includes a cylinder 21 filled with operating fluid 22, a die 23 disposed at one end of the cylinder 21 and a ram 24 for applying pressure to the billet 10 via the operating fluid 22.

Being pressed by the advancing ram 24 via the operating fluid 22, the billet 10 is extruded out of the device through the opening defined at die 23 and a rod 100 of a reduced diameter is obtained. This rod 100 is of a core-and-sheath construction too, i.e. it is composed of a core portion and a sheath portion. It will be well understood that the transverse cross-sectional profiles of the intermediate core and sheath portions of the rod 100 are similar, though reduced in size, to those of the intermediate core 11 and the sheath pipe 12 of the billet 10 before the extrusion.

After completion of hydrostatic extrusion, the intermediate core portion 11 is removed from the rod 100 through solution, which is carried out by, for example, blowing steam therethrough. Simultaneously with this, the center core portion is drawn out of the rod 100.

Figure 3:
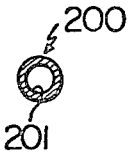
FIG. 3 is a transverse cross-sectional plan view of a tubular body produced in accordance with the present invention.

Thus a tubular body 200 such as shown in FIG. 3 is obtained, the body 200 having a center hold 201 coaxially elongated with the periphery thereof. It will be well understood that the transverse cross-sectional profile of this tubular body 200 is similar, though preferably reduced in dimension, to that of the sheath pipe 12 of the billet 10 shown in FIGS. 1A and 1B.

The following example is illustrative of the present invention, but should not be construed as limiting it.

EXAMPLE

A copper pipe of 63 mm. outer diameter, 5 mm. thickness and 700 mm. length was used for the sheath and 72 axially elongated grooves of 1.0 mm. width and 1.0 mm. depth were formed in the inner peripheral surface thereof by machining. A pure aluminum rod of 28 mm. outer diameter was set in the sheath as the center core and the annular space between the center core and the sheath was filled with sodium chloride having an 800° C. melting point temperature and 20 Hv. hardness, in order to obtain a billet.

The forced plastic deformation was carried out by hydrostatic extrusion in which the compaction ratio was 25.0 and the hydrostatic pressure was 6,300 kg/cm$^2$. The salt core was removed by steam blowing.

The tubular body so obtained was almost similar to the original sheath in its transverse cross-sectional profile. That is, the outer diameter of the tubular body was 12 mm., the thickness was 1.0 mm., the width of its inner axial grooves was 0.2 mm. and the depth thereof was 0.2 mm. It was confirmed that the tubular body so obtained could advantageously be used as a heat pipe with the inner axial grooves excellently functioning as the wick.

In accordance with the process of the present invention, relief of stress takes place within the material processed when the combined sheath metal and core salt are extruded from the highly pressurized interior of the cylinder into the atmospheric situation. This stress relief develops tension in the material which may cause cracking of such a fragile material as salt. In this connection, however, the core salt used in the present invention is combined with the sheath metal in one body and, therefore, the malleable sheath metal relieves the above-described tension. Thus, in accordance with the present invention, the extrusion can well be practiced without trouble. When the extent of the tension relief by the malleability of the sheath metal is rather small, the tension so developed may cause fragile breakage of the core salt. Such unfavorable breakage of the core salt can effectively be prevented by suitably adjusting the relative content of the salt and metal in the material to be processed. It may also be preferable to increase the transverse cross-sectional surface area of the malleable metal sheath. Better results are obtained in substituting malleable metal for a part of the core salt. In other words, a center core made of a metallic material is used. From this point of view, it is preferable that metal having sufficient malleability and higher resistance to the deformation salt should be used for the sheath and the center core.

EXPERIMENTAL RESULTS

It has been found that the use of a salt intermediate core is extremely advantageous with billets whose sheath has a thickness t which is equal to or smaller than 0.11 times the diameter d of the sheath. Particularly, it has been found that when the prior art process described in Armstrong is carried out with a sheath of this construction, the resultant tubular body develops undesirable defects such as surface cracks. In contrast, when the billet of the present invention is extruded in the manner described above, satisfactory results are obtained with t/d ratios of less than or equal to 0.11.

Figure 4:
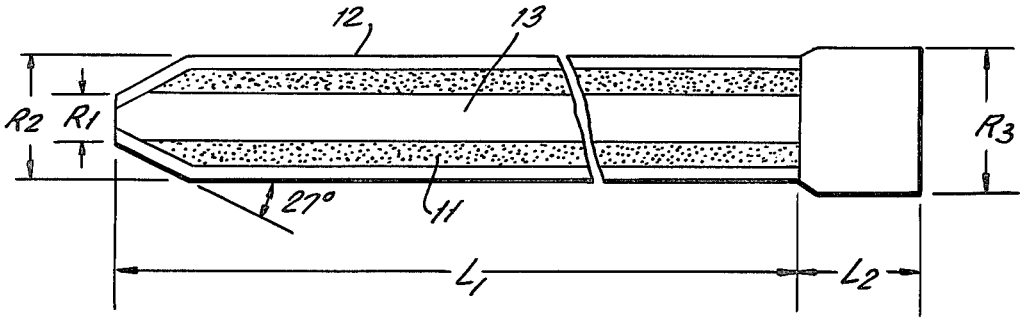
FIG. 4 is a transverse cross-sectional plan view of a billet constructed in accordance with the present invention on which several tests were conducted.

A series of tests have been conducted to compare the results obtained utilizing the billet of the prior art construction and that of the present invention. The general configuration of the four billets tested is illustrated in FIG. 4. The dimensions of the billet are as follows:

R1=20 mm; R2=47 mm; R3=60 mm; L1=285 mm; L2=50 mm

Four separate tests were performed. In each test, the extrusion conditions were as follows:

| | |
|---|---|
| Extrusion diameter | 31.7 mm. |
| Extrusion speed | 85mm/sec. |
| Pressure medium | Castor oil plus methyl alcohol |
| Extrusion die | Super-hard alloy |
| Extrusion temperature | Room temperature |
| Lubricant | ZCu + $MoS_2$ |

Four billets were tested. Each of these billets had the basic dimensions noted above and took the general form of the billet of FIG. 4. The variations of each of the test pieces were as follows:

Test piece I

This test piece included a unitary core of $SiO_2$. This test piece corresponds to that of the unitary core prior art billets.

Test piece II

This test piece included a Cu core with a $SiO_2$ intermediate sheath. This test piece corresponds generally to the prior art disclosed in the Armstrong patent noted above.

Test piece III

This test piece has a unitary salt core ($NaCl+KCO_3$).

Test piece IV

This test piece included an aluminum central core 13 and an intermediate salt core ($NaCl+KCO_3$) 11. This test piece corresponds to the present invention.

The test results of the four tests for various t/d ratios are as follows:

| t/d \ test piece | I | II | III | IV |
|---|---|---|---|---|
| 0.021 | 9,800* | 9,080 | 5,610 | 5,310 |
| | X | X | X | O |
| 0.032 | 9,760 | 9,010 | 5,660 | 5,320 |
| | X | X | X | O |
| 0.042 | 9,750* | 8,950 | 5,750 | 5,350 |
| | X | X | O | O |
| 0.085 | 9,650 | 8,750 | 5,855 | 5,610 |
| | X | X | O | O |
| 0.117 | 9,550 | 8,600 | 5,970 | 5,630 |
| | X | O | O | O |
| 0.128 | 9,600 | 8,550 | 6,050 | 5,700 |
| | O | O | O | O |

*Numerals designate extrusion pressures in $kg/cm^2$
O Successful extrusion
X Development of defects such as surface cracks.

Figure 5:
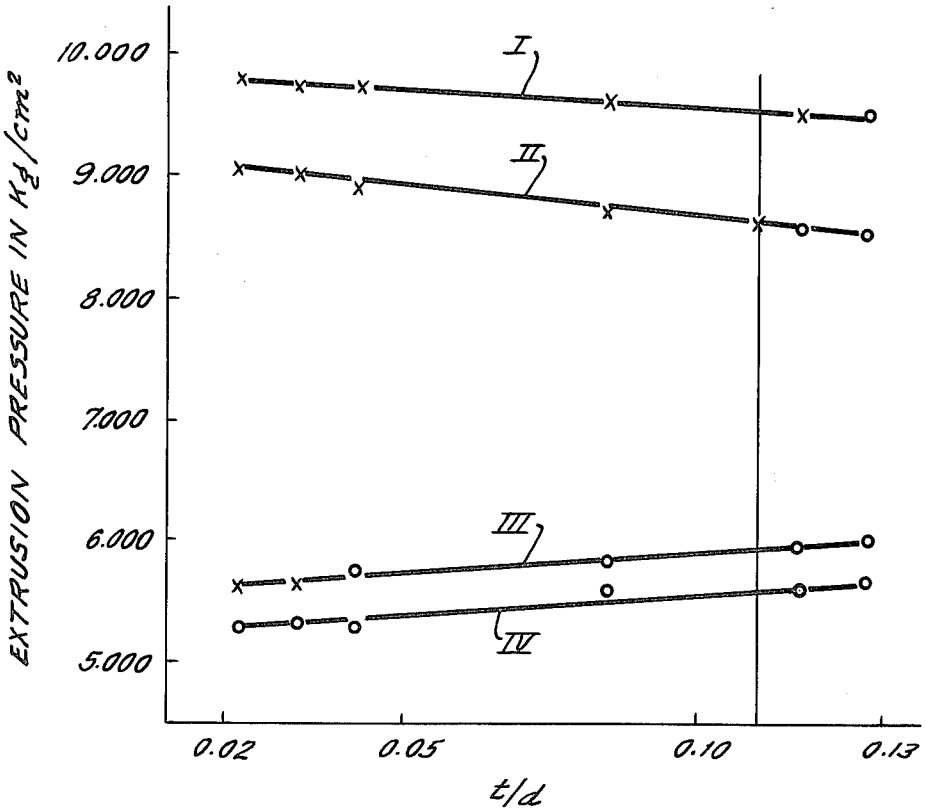
FIG. 5 is a graph illustrating the results of the tests conducted on the billet of FIG. 4.

The foregoing results are illustrated graphically in FIG. 5.

As is clear from the foregoing, the use of an insoluble center core and a salt intermediate core assures a remarkably high degree of precision in the process for producing tubular bodies such as heat pipes even when the extent of diametric reduction by plastic deformation is extremely large, when a tubular body having a large quantity of fine axially elongated radial fins is to be produced, or when billets whose sheath have a t/d ratio of 0.11 or less are used. In addition, use of the insoluble but later removable center core in the core salt assures remarkably reduced pollution of the environment.

The present invention may be embodied in other specific forms without departing from the spirit or essential attributes thereof and, accordingly, reference should be made to the appended claims, rather than to the foregoing specification as indicating the scope of the invention.

What is claimed is:

1. An improved method for producing a tubular body by forced plastic deformation comprising the steps of:

preparing a billet including a metallic tubular sheath, a metallic center core in position within said tubular sheath and an intermediate salt core filling the cylindrical space between said tubular sheath and said center core, the radial thickness t of said sheath being equal to or less than 0.11 times the outer diameter of said sheath;

subjecting said billet to a forced plastic deformation for reducing the diameter of said billet; and thereafter removing said intermediate core through solution and removing said center core by drawing said center core out of said sheath in order to obtain said tubular body.

2. The process of claim 1, wherein said forced plastic deformation is carried out by hydrostatic extrusion.

3. The process of claim 1, wherein said water soluble salt is a simple salt chosen from a group composed of sodium sulfate, sodium carbonate and sodium chloride.

4. The process of claim 1, in which said water soluble salt is a compound salt chosen from a group composed of a compound salt including sodium carbonate with potassium chloride and sodium chloride, a compound salt including sodium carbonate with sodium chloride, a compound salt including sodium carbonate with potassium chloride, and a compound salt including calcium carbonate with potassium chloride.

5. The process of claim 1 or 4, wherein said metallic sheath and metallic center core are each chosen from a group composed of aluminum, copper, brass, mildsteel and alloys of these materials.

6. The process of claim 1, wherein the occupation ratio of said center core in the transverse cross-sectional surface area of the inner space of said sheath pipe is 10% or larger.

7. The process of claim 1, wherein the thickness of said intermediate core is 1.0 mm. or larger.

8. A billet comprising:

an outer metallic tubular sheath, the radial thickness t of said sheath being equal to or smaller than 0.11 times the outer diameter d of said sheath;

a metallic center core positioned within said tubular sheath;

a salt intermediate core filling the cylindrical space between said tubular sheath and said center core.

9. The billet of claim 8, wherein said salt is a simple salt chosen from the group composed of sodium sulfate, sodium carbonate and sodium chloride.

10. The billet of claim 8, wherein said water soluble salt is a compound salt chosen from a group composed of sodium carbonate with potassium chloride and sodium chloride, a compound salt including sodium carbonate with sodium chloride, a compound salt including sodium carbonate with potassium chloride, and a compound salt including calcium carbonate with potassium chloride.

11. The billet of claim 8, wherein said metallic central core and said metallic sheath are each chosen from a group composed of aluminum, copper, brass, mild steel and alloys of these materials.

12. The billet of claim 8, wherein the occupation ratio of said center core in the transverse cross-sectional surface area of the inner spaces of said sheath pipe is 10% or larger.

13. The billet of claim 8, wherein the thickness of said intermediate core is 1.0 mm. or larger.

* * * * *